United States Patent [19]

Boudreau et al.

[11] 4,300,414

[45] Nov. 17, 1981

[54] TORQUE AMPLIFIER

[75] Inventors: Jon P. Boudreau, Gloucester; Marvin A. Biren, Chestnut Hill; Robert J. Maselek, Framingham, all of Mass.

[73] Assignee: The Charles Stark Draper Laboratory, Inc., Cambridge, Mass.

[21] Appl. No.: 892,764

[22] Filed: Apr. 3, 1978

[51] Int. Cl.[3] ..... B25B 13/52

[52] U.S. Cl. ..... 81/64

[58] Field of Search ..... 81/64, 3.43, 3.4, 121 R, 81/90 C, 90 R; 294/33

[56] References Cited

U.S. PATENT DOCUMENTS 1,207,560 12/1916 Keeran ..... 81/64

2,405,462 8/1946 Stair ..... 81/121 R 3,918,756 11/1975 Saville et al. ..... 294/33

*Primary Examiner*—James L. Jones, Jr.

*Attorney, Agent, or Firm*—Joseph S. Iandiorio

[57] ABSTRACT

A torque amplifier for increasing torque applied to rotatable connectors, including a generally perimetrical member for rotation about a central axis; means for inwardly biasing that perimetrical member; connector gripping means carried by said perimetrical member and inwardly directed by said means for biasing; and at least one salient portion extending from the perimetrical member generally in the direction of the axis of rotation of the perimetrical member for increasing applied torque; and a method and a tool for engaging and disengaging the torque amplifier with the connector.

11 Claims, 15 Drawing Figures

TORQUE AMPLIFIER

FIELD OF INVENTION

This invention relates to a torque amplifier for increasing torque applied to rotatable connectors and more particularly to such a torque amplifier which is releasably engageable with a connector.

BACKGROUND OF INVENTION

Conventional connectors such as electrical plugs, especially those of military specifications, require a considerable amount of torque to operate their twist-lock fastening features when engaging and disengaging them. Often the operator must use his whole hand on the plug in order to impart sufficient force to the plug, but frequently this is not possible because the plugs are too close to each other or to other parts of the installation. In those cases, a tool is available to grip the plug but it is unwieldy and difficult to use. In those cases where the tool is most needed, such as when the plug is in a blind or restricted place, it is even more of a problem to use, and the use of the tool increases the likelihood of damage to the plug and surrounding equipment. Many such plugs are in use throughout civilian and military installations and even more are coming into use. In the past, other non-electrical connectors such as threaded nuts have been provided with "wings", but these require some type of permanent deformation of the wing structure or an axial registration means for extensions which penetrate into the top of the nut, which are of no use with nuts that have a bolt extending from them or a plug with a cable extending from it.

SUMMARY OF INVENTION

It is an object of this invention to provide an improved, extremely simple and inexpensive torque amplifier which is easy to install.

It is a further object of this invention to provide such a torque amplifier which is easily installed on, and removed from, conventional connectors such as electrical plugs, nuts, and other couplings where connection is made by rotation of one part relative to another.

It is a further object of this invention to provide such a torque amplifier which inherently grips the connector without permanent deformation of the parts.

It is a further object of this invention to provide such a torque amplifier which increases the torque applied to a connector and allows increased torque to be applied with the fingers rather than the whole hand.

The invention results from the realization that a truly simple and easily installed torque amplifier can be made with a perimetrical member that is biased inwardly to grip a connector on which it is to be mounted, and includes at least one salient portion which can be gripped by the fingers of the user.

The invention features a torque amplifier for increasing torque applied to rotatable connectors. The torque amplifier includes a generally perimetrical member rotatable about a central axis and means for inwardly biasing the perimetrical member. There are connector gripping means carried by the perimetrical member and inwardly directed by the means for biasing. There is at least one salient portion on the member and extending generally in the direction of the axis of rotation of the perimetrical member; two or more such salient portions may be spaced about the member for increasing applied torque. The perimetrical member may be a closed structure completely surrounding the connector, or an open structure which only partly surrounds the connector. It may be rectangular, cylindrical, annular, or any other shape. The means for biasing includes at least one spring section which may be integral with or separate from the perimetrical member, and the gripping means may include a detent extending from the perimetrical member to engage a recess in the connector, or a recess to receive a detent. The gripping means may include friction elements or any other common means for gripping an object. Typically there are two spring sections included in the means for biasing, and the spring sections extend generally parallel to the rotational axis to form salient portions by which increased torque may be applied.

The invention also includes a method of engaging a torque amplifier with a connector by spreading the perimetrical member outwardly against the inward force of the means for biasing until the connector can be inserted therein, and then, following the insertion of the connector, permitting the perimetrical member to retract inwardly under the urging of the means for biasing until the gripping means grips the connector. Disengagement is effected by a similar spreading of the perimetrical member and removal of the connector.

The invention also features a tool for engaging and disengaging the torque amplifier with the connector. The tool includes first and second juxtaposed jaws moveable relative to each other, and means on the jaws for holding the perimetrical member. Actuator means move the jaws away from and toward each other to spread the perimetrical member and permit it to retract, respectively.

DISCLOSURE OF PREFERRED EMBODIMENT

Other objects, features and advantages will occur from the following description of a preferred embodiment and the accompanying drawings, in which.

The invention may be accomplished with a torque amplifier including a generally perimetrical member which rotates about a central axis. The perimetrical member may be complete or partial and it may be circular, rectangular, or any other shape which is compatible with the connector on which it is to be installed. There are spring means for biasing the perimetrical member inwardly. The spring means may be separate or integral with the perimetrical member. The means for biasing may be spring loops formed in the perimetrical member itself, or the perimetrical member may be formed in two different planes with a spring joint which opposes their being bent upwardly and outwardly being formed at their intersection. There are gripping means carried by the perimetrical member and inwardly directed to grasp the connector. The gripping means may be detents for engaging in holes; they may be recesses for engaging detents; or they may be some sort of friction elements or some other device suitable for gripping the connector. The perimetrical member has at least one salient portion which extends upwardly in the direction of the axis of rotation of the member. Typically, but not necessarily, there are two salient portions which are spaced from each other on the perimetrical member, and the means for biasing may be formed so as to serve as a salient portion as well.

Figure 1:
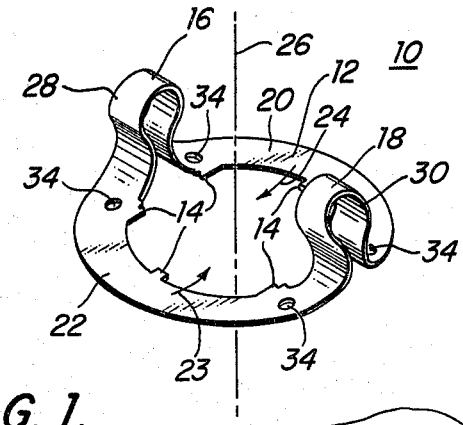
FIG. 1 is an axonometric view of a torque amplifier according to this invention.

There is shown in FIG. 1 a torque amplifier 10 including a perimetrical member, ring 12, which includes a plurality of gripping means, detents 14. Perimetrical member 12 has formed integrally in it a pair of spring loops 16, 18 which are the means for biasing the two parts 20, 22 downwardly and inwardly, as indicated by arrows 23 and 24, toward axis of rotation 26. Spring loops 16 and 18 in this embodiment also act as salient portions 28 and 30 to receive the fingers of the user. Holes 34 in perimetrical member 12 are provided for engagement with the tool discussed, infra, with respect to FIGS. 9 and 10.

Figure 2:
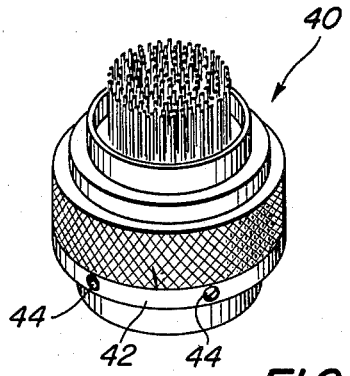
FIG. 2 is an axonometric view of an electrical plug type connector with which the torque amplifier of FIG. 1 is useful.

Torque amplifier 10 is specifically designed to fit on an electrical plug connector 40, FIG. 2, which has spaced about its lower section 42 a number of holes 44 which receive the detents 14 of torque amplifier 10.

In subsequent figures like parts have been given like reference numbers and similar parts like numbers accompanied by a lower case letter.

Figure 3:
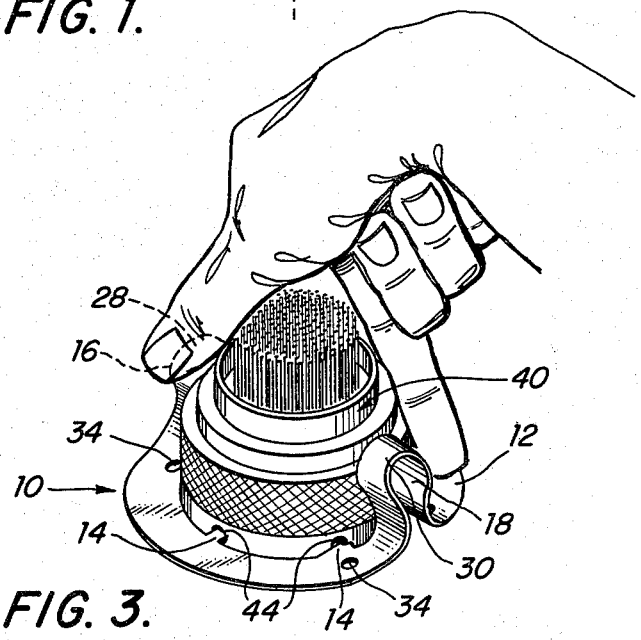
FIG. 3 is an axonometric view showing the torque amplifier of FIG. 1 mounted on the electrical plug connector of FIG. 2.

When torque amplifier 10 is installed, FIG. 3, on connector 40, detents 14 are fully seated in holes 44 of connector 40 and spring loops 16 and 18 act as salient portions, or wings, 28 and 30, which can be gripped by the user to amplify the torque applied to connector plug 40.

Figure 4:
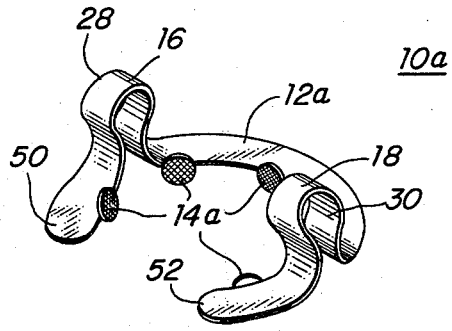
FIG. 4 is an axonometric view of a torque amplifier similar to FIG. 1 showing a partial perimetrical member and friction elements for gripping means.
Figure 5:
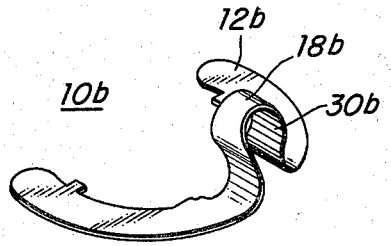
FIG. 5 is an axonometric view of a torque amplifier similar to the one shown in FIG. 1 with a perimetrical member and a single biasing spring.
Figure 6:
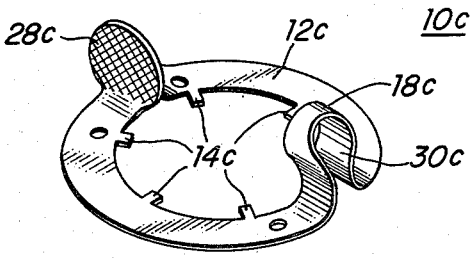
FIG. 6 is an axonometric view of a torque amplifier similar to FIG. 1 with a single biasing spring acting as one salient portion or wing and a wing element acting as the second salient member.

Although in FIG. 1 torque amplifier 10 is shown with perimetrical member 12 having a closed construction, this is not a necessary limitation of the invention, for as shown in FIG. 4 perimetrical member 12*a* may have only a partial structure terminating in open ends 50 and 52. Also in FIG. 4, the gripping means 14*a* are friction elements instead of detents 14, as shown in FIG. 1. In addition, as shown in FIG. 5, the means for biasing may include but one loop 18*b* and there may be but one salient portion or wing 30*b* provided by that spring loop or by some other means. Or, member 12*c*, FIG. 6, may be a closed structure with but one spring 18*c* acting as a salient portion 30*c* and a second salient portion 28*c* with no spring function.

Figure 7:
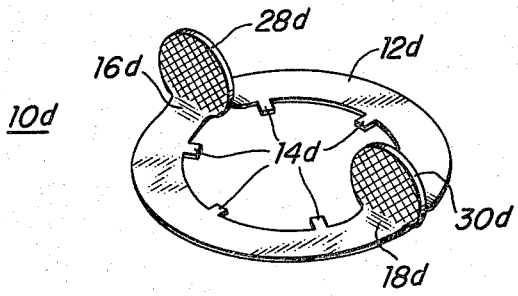
FIG. 7 is an axonometric view of a torque amplifier similar to FIG. 1 using alternative biasing means and wing element salient portions.

The biasing means is not limited to the construction of the spring loop which is shown thus far. It may include separate spring elements or may include an even more simple integral design whereby perimetrical member 12*d*, FIG. 7, is bent downwardly from spring junctions 16*d* and 18*d*, and the salient members are provided by wing elements 28*d* and 30*d*.

Figure 8:
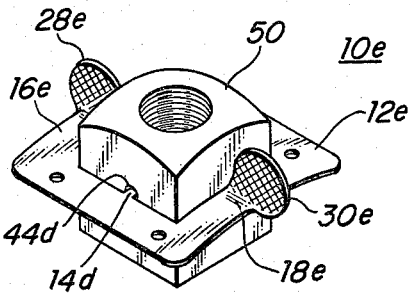
FIG. 8 is an axonometric view of another torque amplifier mounted on a square connector nut.

Although thus far the perimetrical member 12 has been shown as generally circular, this is not a necessary limitation of the invention, as it may take any form required to accommodate the connector on which it is to be mounted. For example, in FIG. 8 torque amplifier 10*e* includes a square perimetrical member 12*e* having spring joints 16*e* and 18*e* similar in function to spring junctions 16*d* and 18*d*, wing elements 28*d* and 30*d*, and detents 14*d* which are engaged in holes 44*d* in a square threaded nut connector 50.

Figure 9:
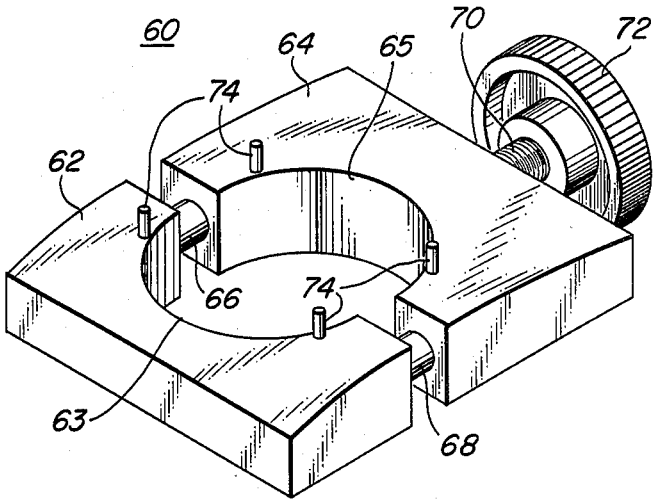
FIG. 9 is an axonometric view of a tool for installing a torque amplifier as shown in FIG. 1 on a connector plug as shown in FIG. 2.
Figure 10:
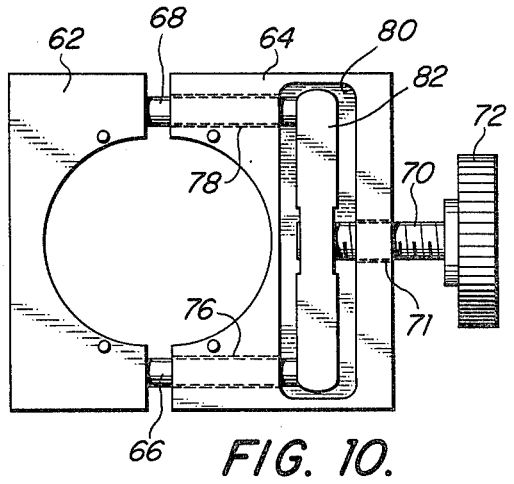
FIG. 10 is a bottom plan view of the tool of FIG. 9.

A simple tool 60, FIG. 9, for installing torque amplifier 10, FIG. 1, on electrical plug connector 40, FIG. 2, includes a pair of jaws 62, 64, moveable relative to each other on rods 66, 68 by means of threaded drive 70 operated by means of handle 72. Jaws 62 and 64 include semicircular recesses 63 and 65, respectively, for receiving electrical connector plug 40 during installation and removal of torque amplifier 10. Pins 74 are provided to engage with the holes 34 on perimetrical member 12, FIG. 1.

Rods 66 and 68 are fixed in jaw 62 and slide through bores 76 and 78 respectively, in jaw 64. Jaw 64 also contains a recess 80 for receiving mounting bar 82, in which the ends of rods 66 and 68 are fixed. Threaded drive 70 is journaled in mounting bar 82 and engaged with threaded bore 71 so that clockwise rotation of handle 72 moves jaw 62 outwardly, away from jaw 64, while counterclockwise rotation moves it inwardly, toward jaw 64.

Figure 11:
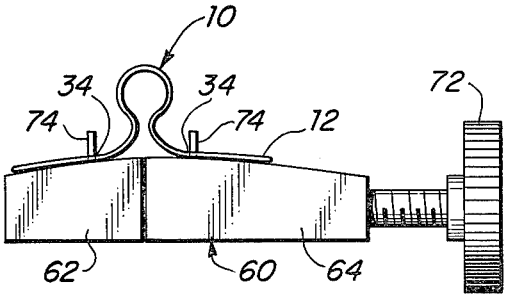
FIG. 11 is a side elevational view of the tool of FIG. 9 with the torque amplifier of FIG. 1 mounted on it in the retracted position.
Figure 12:
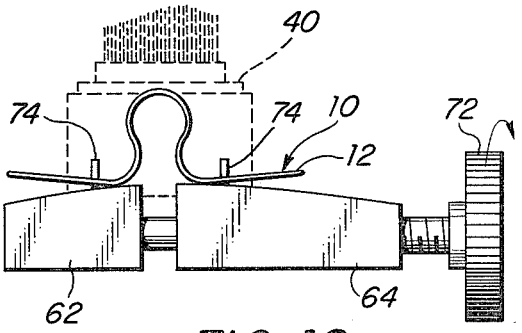
FIG. 12 is a view similar to FIG. 11 with the tool in the open position and the torque amplifier fully spread for receiving a connector plug as shown in FIG. 2.

In operation, torque amplifier 10, FIG. 11, is installed on tool 60 by inserting pins 74 through holes 34. Handle 72 is then rotated in the clockwise direction to move jaw 62 away from jaw 64 and spread torque amplifier 10 so that it can receive connector plug 40. With connector plug 40 so positioned, FIG. 12, handle 72 is rotated in a counterclockwise direction so that detents 14 enter holes 40. The rotation is continued until the tension applied by spring loops 16 and 18 is absorbed wholly by connector plug 40 and torque amplifier 10 may be removed from pins 74. At this stage the spring loops 16 and 18 have caused the perimetrical member 12 to assume more nearly the position shown in FIG. 11.

For removal, connector plug 40 with torque amplifier 10 mounted on it is engaged with tool 60, with torque amplifier 10 and tool 60 in generally the same relation as shown in FIG. 11. Subsequently, when jaws 62 and 64 have separated to the extent shown in FIG. 12, connector 40 may be removed.

Figure 13:
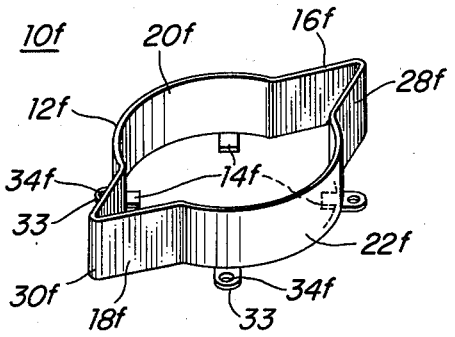
FIG. 13 is an axonometric view of another embodiment of a torque amplifier according to this invention.

Torque amplifier 10*f*, FIG. 13, may also be constructed using a cylindrical perimetrical member 12*f* having spring portions 16*f* and 18*f* which serve to bias the two portions 20*f* and 22*f* inwardly toward the center.

Spring loops 16*f* and 18*f* also function as salient portions 28*f* and 30*f* to receive the fingers of the user. Tabs 33 are provided with holes 34*f* for engaging tool 60, discussed supra.

Figure 14:
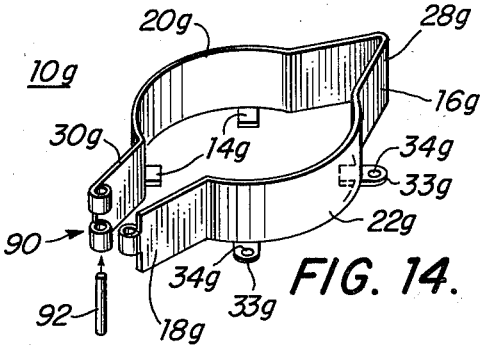
FIGS. 14 and 15 are axonometric views illustrating modified versions of the torque amplifier shown in FIG. 13.
Figure 15:
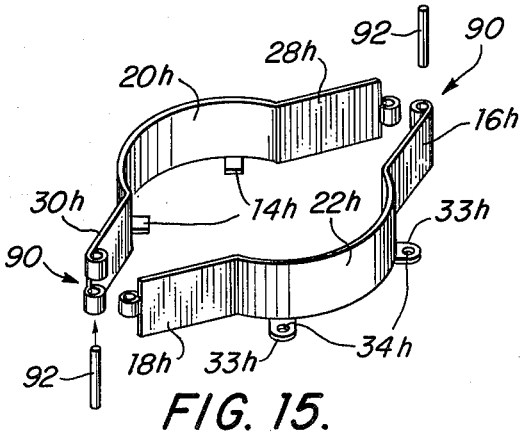

Alternatively, torque amplifier 10*g*, FIG. 14, may have a hinge construction 90 on one spring loop 18*g*, FIG. 14, or both spring loops 16*h*, 18*h*, FIG. 15, each of which is joined by a pin 92. Other constructions may be used to grip bottle covers and container closures for easy removal and replacement.

Other embodiments will occur to those skilled in the art and are within the following claims.

What is claimed is:

1. A tool for engaging and disengaging a connector with a torque amplifier including a generally perimetrical member for rotation about a central axis; means for inwardly biasing said perimetrical member; connector gripping means carried by said perimetrical member and inwardly directed by said means for biasing; and at least one salient portion extending from said perimetrical member generally in the direction of the axis of rotation of said perimetrical member for increasing the applied torque, comprising: first and second juxtaposed jaws moveable relative to each other; means on each of said jaws for holding said perimetrical member; and actuator means for moving said jaws away from and toward each other to spread said perimetrical member and permit it to retract, respectively.

2. A torque amplifier for increasing torque applied to rotatable connectors comprising: a generally perimetrical member for rotation about a central axis; means for inwardly biasing said perimetrical member; connector gripping means carried by said perimetrical member and inwardly directed by said means for biasing; said means for biasing including at least two spring sections integral with the perimetrical member which extend generally in the direction of the rotational axis and form two salient portions for applying increased torque.

3. A torque amplifier for increasing torque applied to a rotatable connector comprising:

a generally perimetrical member for rotation about a central axis;

means for inwardly biasing said perimetrical member;

connector gripping means carried by said perimetrical member and inwardly directed by said means for biasing for preventing relative rotation between said perimetrical member and a said connector; and at least one salient portion extending from said perimetrical member generally in the direction of the axis of rotation of said perimetrical member for increasing the applied torque.

4. The torque amplifier of claim 3 in which said perimetrical member is a closed structure.

5. The torque amplifier of claim 3 in which said perimetrical member is annular.

6. The torque amplifier of claim 3 in which said means for biasing includes at least one spring section integral with the perimetrical member.

7. The torque amplifier of claim 1 in which said gripping means includes at least one detent extending from said perimetrical member.

8. The torque amplifier of claim 6 in which there are at least two said spring sections which extend generally in the direction of said rotational axis and form two said salient portions for applying increased torque.

9. A torque amplifier for increasing torque applied to a rotatable connector comprising:

a generally annular member for surrounding a connector;

means for biasing said annular member inwardly toward the connector;

gripping means carried by said annular member and inwardly directed by said means for biasing for engaging with the connector to prevent relative rotation between the connector and annular member; and at least one salient portion extending from said annular member generally in the direction of the axis of rotation of the connector for applying increased torque to an engaged connector.

10. A method of engaging a connector with a torque amplifier including a generally perimetrical member for rotation about a central axis; means for inwardly biasing said perimetrical member; connector gripping means carried by said perimetrical member and inwardly directed by said means for biasing for preventing relative rotation between said perimetrical member and a said connector; and at least one salient portion extending from said perimetrical member generally in the direction of the axis of rotation of said perimetrical member for increasing the applied torque; comprising: spreading said perimetrical member outwardly against the inward force of said means for biasing; inserting a connector therein; and permitting said perimetrical member to retract inwardly subject to said means for biasing until said gripping means grips the connector.

11. A method of disengaging a connector from a torque amplifier including a generally perimetrical member for rotation about a central axis; means for inwardly biasing said perimetrical member; connector gripping means carried by said perimetrical member and inwardly directed by said means for biasing for preventing relative motion between said perimetrical member and a said connector; at least one salient portion extending from said perimetrical member generally in the direction of the axis of rotation of said perimetrical member for increasing the applied torque, comprising: spreading said perimetrical member outwardly against the inward force of said means for biasing; and extracting said connector.

* * * * *